US005727974A

United States Patent [19]

Wiebenson

[11] Patent Number: 5,727,974

[45] Date of Patent: Mar. 17, 1998

[54] LIQUID-FILLED UNDERWATER SCULPTURAL OBJECT

[76] Inventor: John J. Wiebenson, 1916 S St., NW., Washington, D.C. 20002

[21] Appl. No.: 693,590

[22] Filed: Jun. 27, 1996

[51] Int. Cl.[6] ..... B63B 22/18

[52] U.S. Cl. ..... 441/24; D21/157; 441/28; 441/1

[58] Field of Search ..... 441/1, 6, 21, 23, 441/25, 24, 28, 29, 30; D21/157

[56] References Cited

U.S. PATENT DOCUMENTS

| | | | |
|---|---|---|---|
| 3,048,395 | 8/1962 | Hobbs . | |
| 3,050,750 | 8/1962 | Harrison . | |
| 3,089,155 | 5/1963 | Bengston . | |
| 3,273,181 | 9/1966 | Beck | 441/29 |
| 3,677,539 | 7/1972 | Bennet | 441/23 |
| 3,834,167 | 9/1974 | Tabor | 61/30 |
| 4,028,759 | 6/1977 | Toups | 441/29 |
| 4,047,390 | 9/1977 | Boyce | 61/69 |
| 4,662,301 | 5/1987 | Wolfe | 114/264 |
| 4,775,346 | 10/1988 | Gunter et al. | 441/23 |
| 5,461,816 | 10/1995 | Gazalski | 441/24 |

FOREIGN PATENT DOCUMENTS 2645-451-A 4/1989 France .

*Primary Examiner*—Stephen Avila
*Attorney, Agent, or Firm*—Allen M. Lenchek

[57] ABSTRACT

A flexible envelope made of water-tight material, such as rubber or plastic, partially filled with water, having a bubble of air at its upper end, and a weight at or attached to its lower end, the envelope being shaped and decorated for visual effect, when in use floating submerged in a body of water so as to provide a recreational or informational object.

1 Claim, 4 Drawing Sheets

LIQUID-FILLED UNDERWATER SCULPTURAL OBJECT

BACKGROUND OF THE INVENTION

This invention relates to an underwater buoyant device that provides a visual display conveying information, decoration or artistic display. It may also serve as an object of aquatic recreation. The device comprises a body of flexible water and air tight material, partially filled with water. A bubble of air at the top of the body provides it with appropriate buoyancy and a weight connected to the bottom of the body by an adjustable connecting means anchors the body so that it floats under the surface of the water. The material of the body is decorated with lettering or other symbols to convey information or with patterns for artistic or amusement display.

The prior art discloses a "Diving and Swimming Aid", U.S. Pat. No. 3,089,155 (Bengston, May 14, 1963), comprising essentially a solid body of buoyant material in the form of a one-piece disc made of relatively rigid material connected by a flexible cord to a ballast of material denser than the disc. U.S. Pat. No. 3,048,395 (Hobbs, Aug. 7, 1962) discloses a "Watersports Float" formed of flexible material, the mass having a specific gravity less than that of water. U.S. Pat. No. 3,834,167 (Tabor, Sep. 10, 1974) discloses an inflatable envelope type collapsible dam anchored to the bottom of a body of water. U.S. Pat. No. 4,662,301 (Wolfe, May 5, 1987) discloses a "Floating Platform for Decorative Articles." The present invention is a new and improved underwater buoyant device that may be used as an object of aquatic play or to provide visual information.

SUMMARY OF THE INVENTION

The present invention is a flexible envelope made of water-tight material, such as rubber or plastic, partially filled with water, having a bubble of air at its upper end, a weight at or attached to its lower end. The article is shaped and decorated for visual effect, so as to provide a recreational or informational object submerged in use within a body of water.

DESCRIPTION OF THE INVENTION

Figure 1:
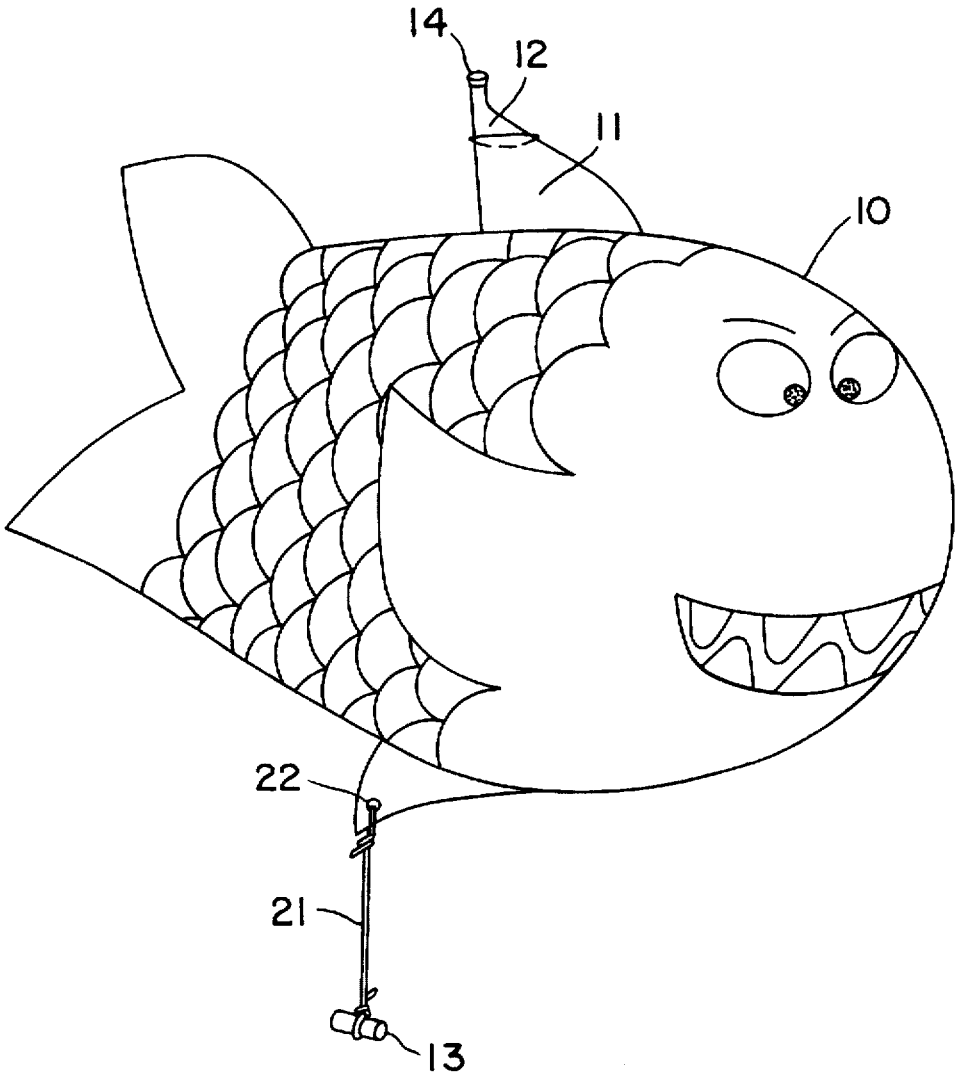
FIG. 1 is a perspective view of an embodiment of the invention.
Figure 4:
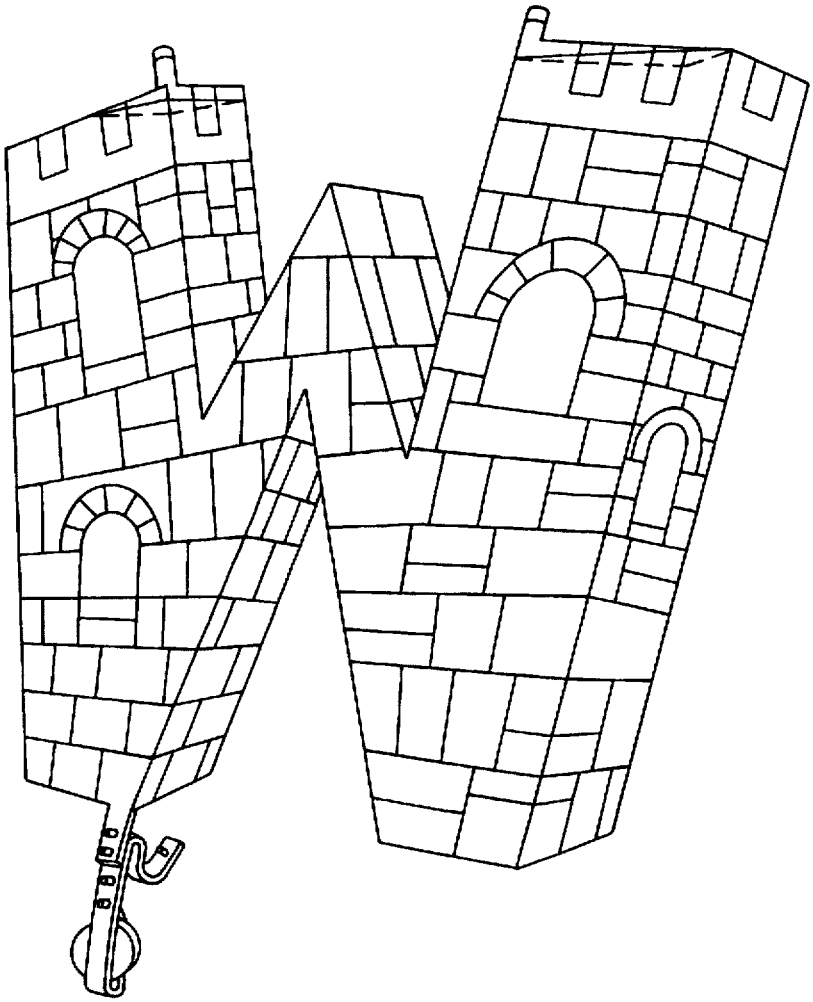
FIG. 4 is a side elevation view of a version of the present invention where the body of the article has the shape of a letter of the alphabet (a "W", marked to appear like a castle).
Figure 5A:
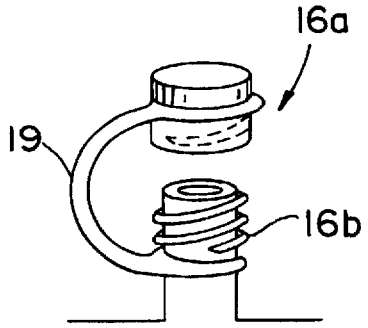
FIG. 5 is a perspective view of four alternative means for filling the body of the article with water.
Figure 5B:
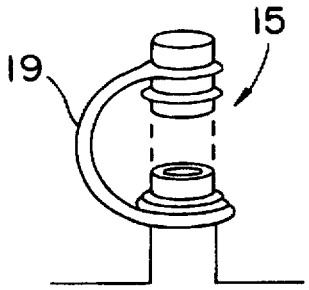
Figure 5C:
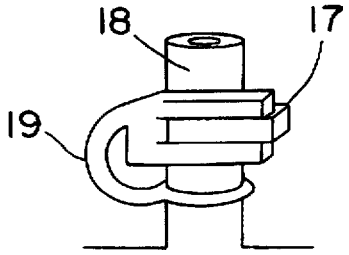
Figure 5D:
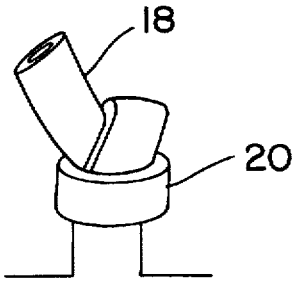

Referring to FIG. 1, the article as a whole is designated by the reference numeral 10. The body of the article 10 may have any shape and is here shown as having the shape of a fish by way of illustration, and not of limitation. The shape may be representative of an animal, either real or imaginary, such as a fish, as shown in FIG. 1, or a dragon, or it may be representative of a vegetable, such as an apple or banana or other, or it may be representative of a non-living object, such a letter of the alphabet, such as shown in FIG. 4.

The shape of the article may be whimsical, such as an octopus or fish, or an arch through which a person may swim, intended for use as a plaything, it may be utilitarian, such as a signboard displaying a warning for underwater swimmers, an object providing information in the form of a sign, such as property lines, depth of water, dangers to avoid, or advertising, or it may be decorative, such as an object of sculpture.

The envelope 10 may be made of transparent, translucent, or opaque material, or any combination thereof.

The liquid 11 that partially fills the article may be installed at the site where the article is used or at some other site. The liquid will most commonly be water. Coloring matter or disinfectants may be added to the water.

When in use, an embodiment of the invention floats suspended under the surface of a body of water, buoyed up by a bubble of air 12 trapped within the upper part of the article 10 and anchored in place by a weight 13 attached to the bottom of the article. A preferred method of use is to partially fill the envelope 10 with water, leaving enough air within the envelope to provide positive buoyancy.

Means 14 for filling the body 10 with water or other liquid 11 is provided at or near the uppermost point of the body of the article. Such means, shown in FIG. 5, may be an air-tight sealable valve of the familiar tube and stopper 15 design, or a threaded cap **16*a* disposed to fit threadably upon a threaded filling tube 16*b* or a removable pronged clip 17 disposed to squeeze shut the filling tube 18. The cap 16*a*, stopper 15, or pronged clip 17, is attached to the filling tube 18 by a security strap 19 loosely joining the cap, stopper or clip to the filling tube to prevent it from being mislaid. Said means may alternatively be a knot 20 in the flexible tube 18**.

Figure 3:
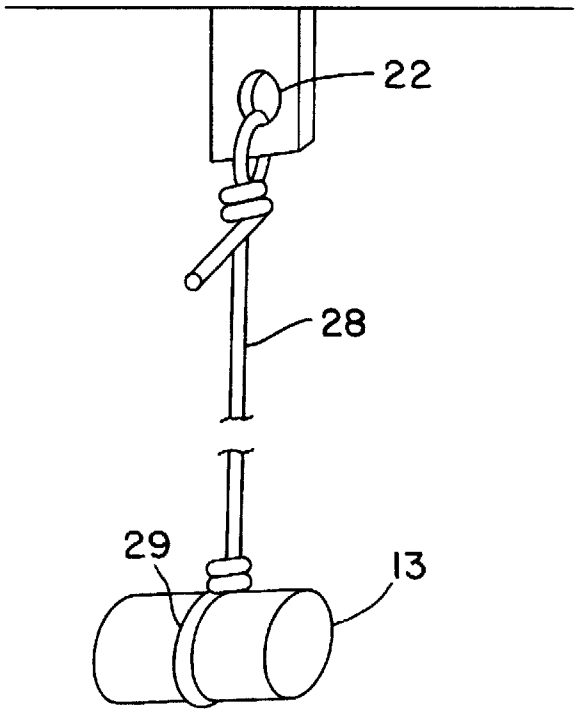
FIG. 3 is an enlarged, fragmentary, perspective view of the knotted cord weight connecting means.
Figure 2:
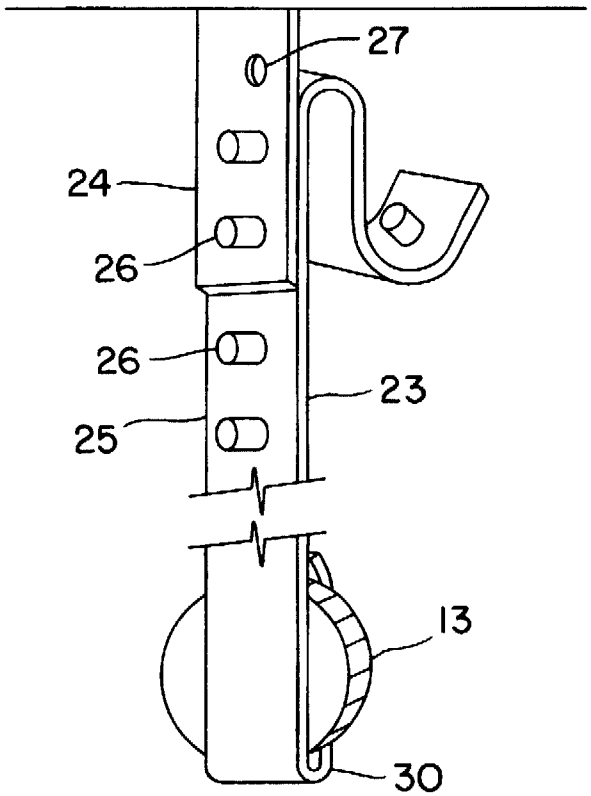
FIG. 2 is an enlarged, fragmentary, perspective view of the hole-and-peg strap weight connecting means.

An embodiment of the invention is anchored by the weight 13. The weight 13 is attached to the bottom of the envelope by a weight connecting means 21. The weight connecting means 21 may be a weight connecting strap or cord. In a preferred embodiment, the weight connecting means 21 is adjustable in length. Adjustability of length may be provided by making the weight connecting means 21 a rope or cord secured to the envelope by tying it through an eyelet 22 positioned at the lowest point of the body. FIGS. 1, 3. In a preferred embodiment, the weight connecting means is a weight connecting strap 23 of adjustable length comprising two overlapping congruent sections 24, 25 with pegs 26 along the longitudinal centerline of section 25 that fit snugly into holes 27 in the matching section 24, disposed along the centerline thereof, by force fit.

The weight 13 may be installed by the manufacturer or may be installed by the user. In the latter case, the weight may be a rock or other heavy object having specific gravity high compared to water and provided by the user, tied to the weight connecting means by a knotted loop 29 in the cord 28 or by a loop 30 in the weight connecting strap 23.

Although the present invention has been described in connection with preferred embodiments, it will be appreciated by those skilled in the art that additions, modifications, substitutions and deletions not specifically described may be made without departing from the spirit and scope of the invention defined in the appended claims. The described embodiments of the invention are not exhaustive of the application of the invention, and are given as examples only.

What is claimed is:

1. An article for use underwater comprised of a body consisting of a flexible envelope made of material that is impermeable to air and water, when in use having a highest point thereof and a lowest point thereof, the envelope having affixed thereto at its lowest point a weight connecting means, said weight connecting means being connected to a weight, said article when in use being partially filled with water and partially filled with air with the weight disposed on the weight connecting means so that when the article is immersed in a body of water the weight rests upon the bottom of the body of water and the article floats beneath the surface of the water, wherein the weight is a solid of specific gravity high compared to water and connected to the bottom of the envelope by a strap of flexible material, and wherein the strap is adjustable in length, and wherein the strap comprises two overlapping congruent pieces, one piece having a row of pegs along the longitudinal centerline thereof, and the other piece having a row of holes along the longitudinal center line thereof disposed to receive the pegs, said pegs being sized so as to force fit into said holes.

* * * * *